US005165432A

United States Patent [19]

McKibben

[11] Patent Number: 5,165,432

[45] Date of Patent: Nov. 24, 1992

[54] METAL CHIP WASHING SYSTEM

[75] Inventor: Kenneth D. McKibben, Defiance, Ohio

[73] Assignee: CMI International, Inc., Southfield, Mich.

[21] Appl. No.: 821,313

[22] Filed: Jan. 13, 1992

Related U.S. Application Data

[63] Continuation of Ser. No. 569,870, Aug. 20, 1990, abandoned.

[51] Int. Cl.[5] ..... B08B 3/06

[52] U.S. Cl. ..... 134/65; 15/302; 15/305; 34/135; 134/66; 134/107

[58] Field of Search ..... 134/60, 65, 107, 132, 134/66, 67, 68, 69, 71, 72, 73; 15/302, 305; 68/143; 366/227; 34/135, 136, 137

[56] References Cited

U.S. PATENT DOCUMENTS

| | | | |
|---|---|---|---|
| 1,422,309 | 7/1922 | Schweinsberg et al. | 134/65 |
| 1,571,076 | 1/1926 | Warren | 34/135 X |
| 1,573,340 | 2/1926 | Weitman | 366/227 X |
| 1,647,763 | 11/1927 | Aldeen | 34/135 X |
| 2,427,388 | 9/1947 | Curran | 134/132 |
| 2,684,560 | 7/1954 | Swanson | 134/65 |
| 2,978,229 | 4/1961 | Jackson | 34/135 X |
| 3,117,031 | 1/1964 | Griffiths | 134/132 X |
| 3,683,945 | 8/1972 | Weisser | 134/68 |
| 3,727,621 | 4/1973 | Morton | 134/65 X |
| 4,073,301 | 2/1978 | Mackinnon | 134/65 |
| 4,719,933 | 1/1988 | Jackson | 134/65 |
| 4,813,154 | 3/1989 | Ronning | 34/137 X |

FOREIGN PATENT DOCUMENTS

| | | | |
|---|---|---|---|
| 136512 | 6/1960 | U.S.S.R. | 366/227 |

*Primary Examiner*—Philip R. Coe

*Attorney, Agent, or Firm*—Harness, Dickey & Pierce

[57] ABSTRACT

Scrap metal chips, which may be oily, wet and dirty and which may be of varying lengths and widths, twisted, curled and cracked, resulting from machining metal articles, are cleaned and dried by passing them sequentially through a washer cylinder, a rinse cylinder and a dryer cylinder. A thread formed of a plate-like metal strip is secured within the interior surface of each cylinder to provide a deep, spiral trough within each cylinder. Each cylinder is rotated so that the chips are moved, in a tumbling motion, along the troughs due to the auger-like thread, from one end to the opposite end. A hot, aqueous washing solution is flowed through the washer cylinder in a direction opposite to the movement of the chips. Similarly, a hot rinse water is flowed through the rinse cylinder in a direction opposite to the movement of the chips therethrough. Hot air is flowed through the dryer cylinder along its central axis and then, radially outwardly of its axis, for impinging upon and drying the chips moved along the dryer cylinder.

7 Claims, 2 Drawing Sheets

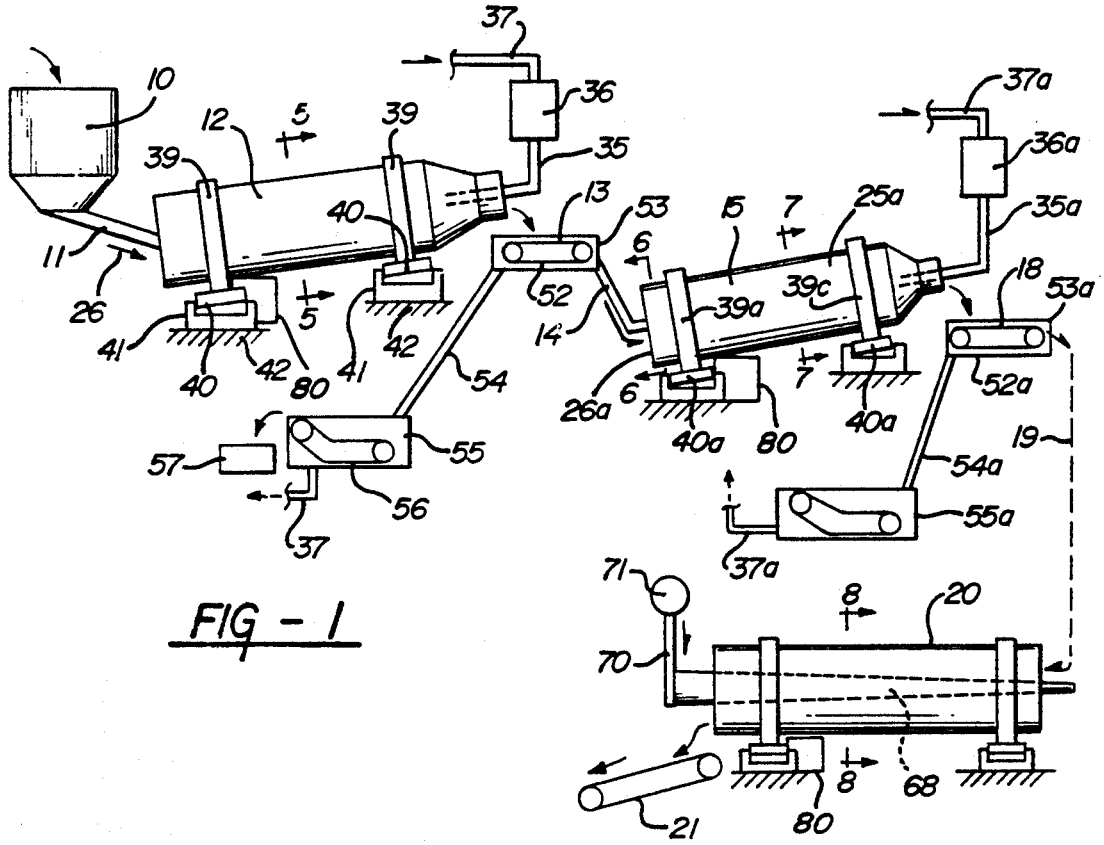
FIG - 1
FIG - 2
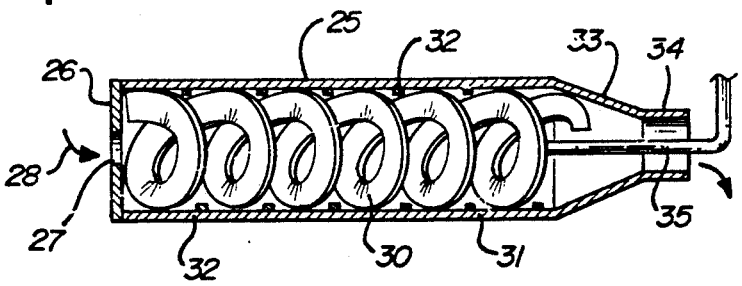
FIG - 3
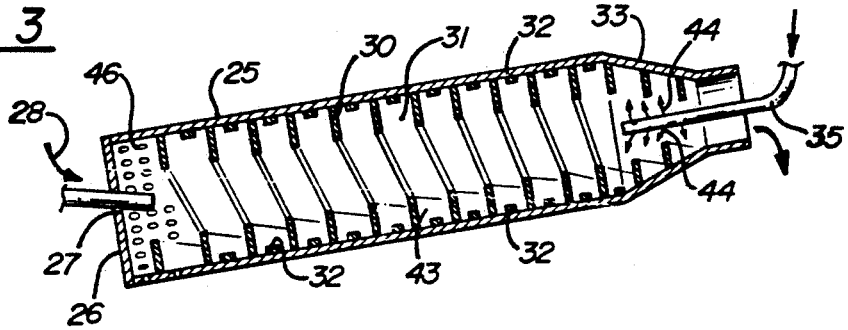

METAL CHIP WASHING SYSTEM

This is a continuation of U.S. patent application Ser. No. 569,870, filed Aug. 20, 1990 now abandoned.

BACKGROUND OF INVENTION

In the manufacture of metal articles by machining processes, such as cutting, drilling, milling and the like, the removed metal generally is in the form of chips of varying lengths and sizes. These scrap chips commonly are twisted or curly and usually include numerous cracks or fissures. Conventional machining processes usually utilize coolant liquids, oils and the like. Also, chips frequently become dirty after removal from the machined articles. Thus, recycling the chips, by melting them into molten metal for reuse, creates problems due to their oil, moisture or dirt contents.

In the case of foundries, such as aluminum or ferrous metal casting foundries, where machine shops are associated with a foundry for machining and finishing the cast articles, it is possible to reuse chips by melting them in the foundry furnaces. But, where the chips contain oil, moisture or other liquids or dirt, furnace and other problems are created by using such chips.

Thus, it would be desirable to have available, in a machine shop or other location where substantial quantities of scrap chips are available, a means for cleaning and drying the chips so that they may be either compacted, such as into briquetting, for later use as melt stock for charging a furnace, or for direct use as loose chips forming a melt stock. Since the typical chips are variable in size, shape, configuration, and particularly, contain numerous cracks or fissures, it is very difficult to remove oil or other liquids from these, frequently minute, openings in the chips. Thus, it would be desirable to have a washing and drying system which is able to inexpensively wash and dry any metallic chips, regardless of their sizes, shapes, configurations or the like, and particularly clean the cracks and fissures normally found within the chips. This invention relates to a system including an apparatus and a method, for washing and drying loose scrap chips.

SUMMARY OF INVENTION

The invention herein contemplates washing and drying scrap metal chips resulting from machining operations by sequentially passing the chips through a washer, rinser and dryer which are formed of approximately horizontally arranged, elongated, rotating cylinders. Each of the cylinders is provided with a continuous, deep, spiral-like trough extending along its interior wall surface from one of its ends to its opposite end. These troughs are formed of thin, plate-like strips which are bent or configured into a screw-like thread shape whose outer, peripheral edges are fastened against the cylinder walls and whose inner edges are spaced a distance from the central axis of the cylinders. Thus, chips are placed into one end of each cylinder and moved, along the trough, by an auger type action of the thread, towards the opposite end of the cylinder. In the case of the washer cylinder, a hot washing solution is flowed through the trough, in the opposite direction to the movement of the chips, for washing the chips as they move through the trough. Similarly, a hot rinse liquid is flowed through the rinse cylinder in the opposite direction to the movement of the chips therethrough.

Conveyor means are provided for moving the chips from the washer cylinder to the rinser cylinder and then, from the rinse cylinder to the dryer cylinder. The dryer cylinder is provided with a similar deep trough formed by the screw-like thread formed on its interior wall. However, it is also provided with a central tube which conveys hot air through the center of the dryer cylinder. The tube is provided with openings so that the air may flow radially outwardly from the tube into the trough for impinging upon, and for drying, the chips as they move through the dryer cylinder.

The sequential arrangement of the washer, rinser and dryer cylinders permits continuous treatment of large quantities of chips at minimal cost and with very little labor needed for the treatment.

Thus, it is an object of this invention to provide an inexpensive apparatus and method for washing and drying scrap metal machining chips in large quantities to convert scrap chips into a condition useful for furnace charges.

A further object of this invention is to provide an inexpensive, sturdy, cylindrically shaped washer, rinser and dryer which ma be formed of metal drum-like cylinders within which continuous conveying troughs are formed by welding rigid, narrow, plate-like strips, that are bent in a screw thread shape, against the interior wall of each cylinder. Thus, chips may be augered from one end of each cylinder to the opposite end while a washing solution or a rinse water or hot air, respectively, may be circulated through these cylinders in the opposite direction for treatment of the chips as they move along their troughs.

Still a further object of this invention is to provide a chip cleaning installation which may rapidly and inexpensively convert large quantities of scrap metal chips into a usable melt furnace charge which is clean and dry for minimal disturbance of the furnace when the charge is inserted.

An additional object of this invention is to provide a device which moves chips within a container in one direction, in a controlled path, while permitting the counterflow of liquid or air along the same path, but in the opposite direction, for treating the chips for a maximum length of time, but within a relatively short distance, for insuring complete cleaning of the chips.

These and other objects and advantages of this invention will become apparent upon reading the following description, of which the attached drawings form a part.

DESCRIPTION OF DRAWINGS

FIG. 1 is a schematic view of the system.

FIG. 2 is a schematic, partially cross sectioned view of the washer.

FIG. 3 is a schematic, enlarged, cross sectional view of the washer.

DETAILED DESCRIPTION

Figure 4:
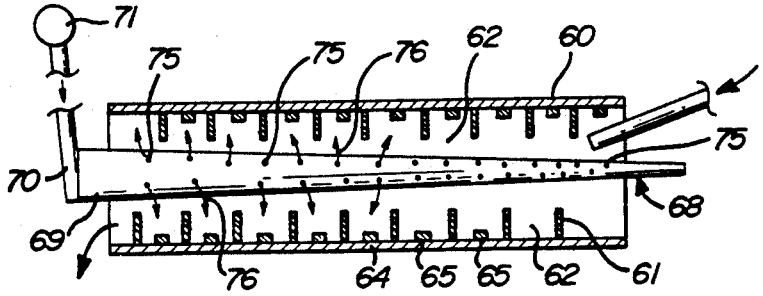
FIG. 4 is a schematic, cross sectional view of the dryer.

The metal chip washing system is schematically illustrated in FIG. 1. The system includes a hopper 10 within which the chips which are to be cleaned are stored. Typically, the chips would be of a single metal, such as aluminum chips or shavings or, alternatively, a particular steel or iron material or the like. These chips, when received from the shop in which machining is performed, typically are twisted or curled, of different lengths, widths and thicknesses and contain numerous cracks or fissures. The chips commonly are coated with oil or lubricating liquids of the kinds used with machine tools, as well as moisture and dirt.

At the outset, chips are fed through a chute or conveyor 11 into a washer 12, which will be described in detail below. From the washer the cleaned chips drop upon a dewatering screen-type conveyor 13 for draining free liquid from the chips. The chips are conveyed by suitable conveyor means or by a conveyor chute 14 into the feed end of a rinser 15. The rinser removes any residual cleaning solution which had been used in the washer.

From the rinser, the chips are dropped upon a dewatering screen conveyor 18 and conveyed by conventional conveyor means or by a conveyor chute 19 (schematically shown in dotted lines) into a dryer 20. There, the chips are dried. Upon leaving the dryer, the chips are taken away upon a conveyor 21.

As schematically illustrated in FIG. 2 and in FIG. 3, the washer 12 is formed of an elongated drum-like cylinder 25. The cylinder is approximately horizontally arranged, that is, it is slightly tipped relative to the horizontal. (See FIGS. 1 and 3).

The rear or entry end 26 of the cylinder is closed except for a central opening 27 through which chips may be fed, as shown by arrows 28. (See FIG. 2).

Figure 10:
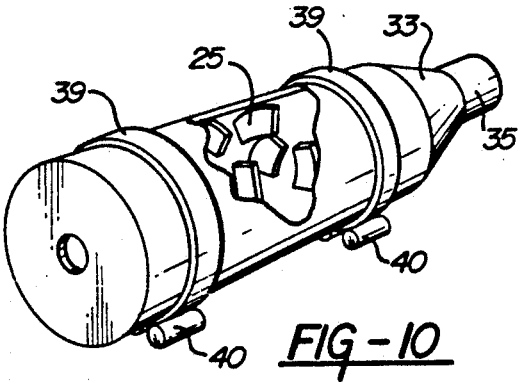
FIG. 10 is a perspective view partially in cross section of the washer.
Figure 11:
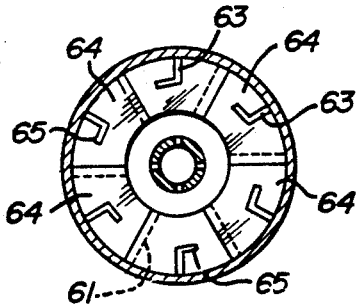

An auger, formed of a screw-like thread 30, made of a bent, rigid, thin, metal strip which resembles a flat, coil spring, is positioned within the cylinder and extends substantially its entire length (see FIG. 3). The auger may be continuous (FIG. 3) or formed of short sections that are aligned but offset from their adjacent sections to provide a discontinuous thread (FIG. 10). The outer edge of the strip may be welded to the inner wall of the cylinder. The spaces between the thread-like coils provide an inwardly extending spiral dam with a continuous, spiral, deep trough 31 extending the length of the cylinder. Within the trough, at various locations therein, projections 32 are provided. These may be in the form of V-shaped sheet metal pieces welded in place.

The forward or higher end of the cylinder is provided with a truncated conical end portion 33 which terminates in a forwardly extending cylindrical exit end portion 34.

A tube 35 extends into the cylindrical end 34 of the cylinder and carries an aqueous cleaning solution, such as a mixture of some suitable detergent and water or the like. Preferably, the mixture is heated in a conventional heater 36 (see FIG. 1). A return pipe 37 (see FIG. 1) returns used cleaning solution to the heater for recycling, as will be further described.

The washer cylinder is rotated by a suitable, conventional rotating mechanism. An example of a rotating mechanism, which is schematically illustrated in FIGS. 1 and 10, includes support rings 39 encircling the cylinder at its forward and rear ends. These rings rest upon pairs of rollers 40 which are rotatably supported upon pillow blocks 41 which, in turn, are supported upon a solid ground or support base 42. The support rollers 40 may be rotated by a motor 80 or, alternatively, any other conventional motor driven equipment may be provided for rotating the cylinder.

Figure 5:
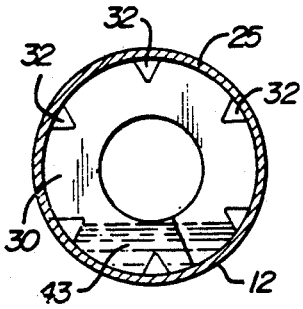
FIG. 5 is a cross sectional view of the washer, taken in the direction of arrows 5—5 of FIG. 1.
Figure 6:
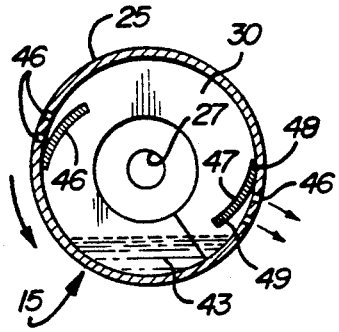
FIG. 6 is an enlarged, cross sectional view of the rinser taken as if in the direction of arrows 6—6 of FIG. 1.
Figure 7:
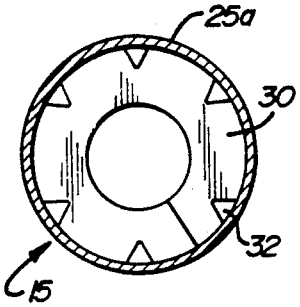
FIG. 7 is an enlarged, cross sectional view of the rinser taken in the direction of arrows 7—7 of FIG. 1.
Figure 9:
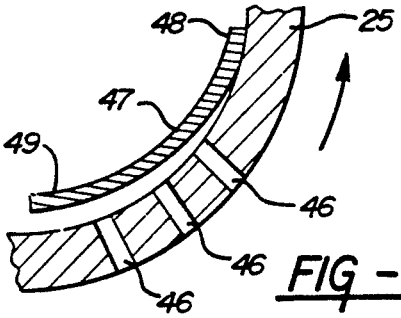
FIG. 9 is an enlarged, cross sectional, fragmentary view of an end portion of the washer, schematically illustrating the liquid drain openings and the protective plate therefor.

The chips which enter through the opening 27 in the lower end 26 of the cylinder 25 are fed by the screw-like thread along the length of the washer until the chips exit through the upper cylindrical end 34. Thus, the thread acts like an auger, moving the chips through the continuous, deep trough formed by the spiral thread. As the chips travel through the trough, they are tumbled in all directions because of either impacting against or being impacted by the projections 32 provided upon the inner surface of the cylinder in the continuous trough 31. Meanwhile, the cleaning solution 43 is sprayed into the upper end of the cylinder through high-pressure nozzles (represented by arrows 44 in FIG. 3) mounted upon the tube and receiving the solution through holes formed in the tube. Thus, the aqueous cleaning solution sloshes about in the cylinder and is restrained from freely pouring towards the low end by the dike-like walls formed by the flat, plate-like, thread. As schematically illustrated in Fig. 3, the liquid fills the space between adjacent coils or teeth (e.g., see FIGS. 3 and 5) and then spills over the inner edges of the thread teeth from space to space between the teeth, like water flowing over a dam, until ultimately reaching the lower end of the cylinder. This action agitates the chips in each succeeding trough section. Then the liquid exits through holes 46. These holes or openings 46 (see FIG. 9) are guarded by curved cover plates 47 which have a lead end 48 welded or otherwise fastened to the interior surface of the cylinder and trailing end portion 49 which overlaps but is spaced inwardly from the holes.

The conveyor 13 which receives washed chips exiting from the washer, includes a dewatering screen, such as an endless belt made of foraminous material 52 arranged within a tank 53. The screen may also be vibrated. A commercially available dewatering conveyor may be used.

The liquid is drained from the tank through a drain pipe 54 which deposits the liquid cleaning solution that drips from the chips into a reservoir tank 55. A suitable debris catching screen or filter 56, such as in the form of an endless belt, is arranged within the tank and carries the debris out of the tank into container 57 for disposal. Meanwhile, the liquid from the reservoir exits through the return pipe 37 back to the heater 36. The chips from the belt 52 are carried through the conveyor means or chute 14 into the entry end 26*a* of the rinser 15. The rinser 15 is a substantial duplicate of the washer and, therefore, is shown schematically in FIG. 1 to be of the same construction. However, it may be somewhat shorter in length than the washer 12. Thus, it is formed with a cylinder 25*a* that is provided with rings 39*a* supported upon rollers 40*a* in the same manner as the rollers 40 support the washer.

The rinse fluid, preferably hot water, is sprayed into the upper end of the rinser cylinder through a tube 35*a* that receives hot water from the heater 36*a*. The heater, in turn, is supplied with fresh water from a suitable outside source as well as recycled water, where desirable, through a return line 37*a* which receives the water from a reservoir 55*a*. The reservoir water enters through a drain pipe 54*a* from the conveyor tank 53*a* containing a dewatering screen or conveyor belt 52*a* similar in construction to that described in connection with the washer.

The washed chips travel through the rotating cylinder 25*a* of the rinser 15 along the deep trough contained therein and formed by the screw-like strip. When the chips flow through the rinser cylinder, they are tumbled and tossed about by the internal projections as well as by the sloshing movement of the rinse water until the chips reach the upper exit end. Then the chips fall upon the dewatering conveyor 52*a* and are conveyed by the conveyor 19 to the dryer 20.

Figure 8:
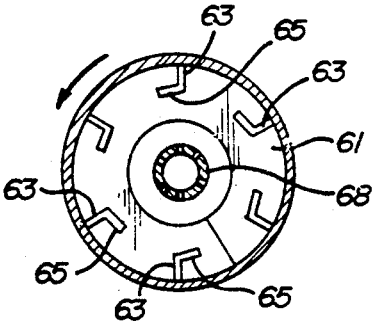
FIG. 8 is an enlarged, cross sectional view of the dryer, taken in the direction of arrows 8—8 of FIG. 1.

The dryer 20, as shown in FIGS. 1, 4 and 8, is formed of an elongated, generally horizontally arranged, cylinder 60 containing a screw-like thread 61. Preferably, the cylinder is angled slightly relative to true horizonal. The thread 61 may be continuous to form a deep continuous trough 62 (see FIG. 4) containing projections 63. Alternatively, the thread may be discontinuous, that is formed in short sections 64 which ar axially offset from adjacent sections rather than of a single strip. Projections 63 whose inner edges 65 may be bent at an angle form generally L-shaped in cross-section lifters or agitators. Thus, the chips are tumbled and thrown about by the lifters within the continuous or discontinuous trough as the chips move from one end of the dryer cylinder to the other lower end.

Lifter projections 63 may be arranged in the washer and rinser drums either along with, or in place of the projections 32. Similarly, V-shaped projections may be arranged within the dryer drum. The dryer cylinder is rotated by the same type of mechanism used for rotating the washer and rinse cylinders.

An elongated, preferably tapered, tube 68 extends through the center of the washer. Its larger end 69 is connected through a pipe 70 to a hot air pump 71 (schematically illustrated in Figs. 1 and 4) for flowing hot air in large quantities through the tube 68. The air travels longitudinally, along the axis of the dryer. In addition, the air exits from the tube in a radially outwardly direction through holes 75, as illustrated by the arrows 76 in the cross sectional view which diagrammatically illustrates the flow of air in FIG. 4. Thus, the chips are dried by the impinging warm air as they move along the trough within the drier cylinder. Finally, the chips exit from the cylinder and are deposited upon the conveyor 21 which carries them to the next operation. That may comprise a storage area, or a transportation means for carrying the chips to some other location, such as vehicle or cart or container or the like. Alternatively, the chips may be fed through a briquetting machine (not shown) for compacting the chips into brick-like shapes.

The overall system described above automatically processes a large quantity of chips in a continuous manner. That is, with suitable conventional conveyors, the system may operate without any labor, except supervisory and maintenance labor. Hence, an inexpensive system is provided for converting substantially useless scrap chips into clean, ready to use, melt stock for insertion into a metal melt furnace. While the system is useful in a variety of industrial locations for processing scrap chips, it is particularly useful in machining operations associated with foundries where, on the one hand, chips are generated by machining castings and, on the other hand, melt furnaces are available to receive clean melt stock for immediate melting into usable casting metal.

This invention may be further developed within the scope of the following claims. Accordingly, it is desired that the foregoing description be read as being merely illustrative of an operative embodiment of this invention and not in a strictly limiting sense.

Having fully described at least one operative embodiment of this invention, I now claim:

1. Apparatus for washing and drying metal chips resulting from machining articles, which chips generally may be of varying lengths and sizes and may be twisted and curled, and may include numerous cracks and fissures, and which chips may be oily, wet and dirty, comprising:

a washer, rinser and dryer independent of one another and arranged sequentially, with each being formed of an approximately horizontally arranged, elongated cylinder;

means for rotating each cylinder about its axis;

a screw-like auger secured upon the interior wall surface of each cylinder providing spaced apart threads having external edges secured to their adjacent cylinder interior wall surfaces and interior edges spaced radially outwardly of the axis of their cylinders, with the spaces between the threads forming spiral-like, deep troughs extending longitudinally along the interior of the cylinder wall surfaces;

the washer and rinser cylinders each being slightly tipped relative to horizontal, and each having a lower end forming a rear, chip entry end and a higher end forming a chip exit end;

means for flowing an aqueous cleaning solution and a water rinse, respectively, into higher ends of the washer and rinser cylinders, so that the liquid flows through and over the trough from the higher end of the cylinder to the lower end of the cylinder and out through the lower end of the cylinder while the chips ar moved by the auger, through the cylinder to the higher end of the cylinder for exiting therefrom;

means for feeding chips into the washer cylinder rear end and conveyor means for conveying chips from the washer cylinder higher end into the rinse cylinder lower end, said conveyor means positioned below said washer higher end and including a dewatering screen type conveyor positioned within a tank, piping means for draining said tank into a reservoir rank, recirculation means coupled with said tank for returning said cleaning solution to said flowing means associated with said wash cylinder, and a conveyor chute means coupled with said dewatering screen conveyor for transferring chips to said rinser cylinder, and conveyor means for conveying chips from the rinser cylinder higher end into the dryer cylinder lower end, said conveyor means positioned below said rinser higher end and including a dewatering screen type conveyor positioned within a tank, piping means for draining said tank into a reservoir tank, recirculation means coupled with said tank for returning said cleaning solution to said flowing means, associated with said rinser cylinder and a conveyor chute means coupled with said dewatering screen conveyor for transferring chip to said dryer, means for blowing hot air into the dryer cylinder for drying chips moved therethrough by its auger and said dryer cylinder including internal, radially extending projections formed on the cylinder walls between the threads for engaging and tumbling and throwing the chips within the trough as the cylinders rotate moving the chips along the dryer, at least some of said projections being formed in a generally L-shaped cross-section with both legs of the L extending into the cylinder to form lifters for lifting and tumbling the chips engaged thereby;

and means for receiving the removing dry chips exiting from the dryer cylinder.

2. An apparatus as defined in claim 1, and including said aqueous cleaning solution and the rinse water being preheated before flowing into the respective cylinders.

3. An apparatus as defined in claim 1, and said dryer cylinder having a central, generally coaxial tube through which hot air is flowed through the cylinder, and with the tube having openings formed therein for flowing hot air from the tube into the dryer cylinder trough, that is, between the screw-like threads formed within the dryer cylinder, for impinging upon the chips within the trough for drying the chips as they are moved along the trough through the cylinder.

4. An apparatus as defined in claim 1, and including means for rotating each cylinder comprising a rotating support upon which the cylinder is supported and power means for rotating the support and the cylinder supported thereon.

5. An apparatus as defined in claim 1, and including drain openings formed in the washer and rinser cylinders in their walls at their lower end portions, and with cover plates having edge portions secured to the cylinder walls adjacent drain openings, along the lead edges of the plates, that is, the edges leading as the cylinders rotate, and the plates having trailing portions, that is, trailing relative to the direction of rotation of the cylinders, that overlap and are spaced radially inwardly of the wall openings for protecting the wall openings against the entry of chips.

6. An apparatus as defined in claim 1, and said screw like augers forming a strip being continuous in length to provide a single continuous thread.

7. An apparatus as defined in claim 1, and said screw like augers forming a strip being formed of short sections that are aligned, but offset from their adjacent sections to provide a discontinuous thread.

* * * * *